United States Patent [19]

Salomon

[11] 4,145,071

[45] Mar. 20, 1979

[54] SAFETY BINDING FOR SKI-BOOT WITH AUTOMATIC REFITTING

[75] Inventor: Georges P. J. Salomon, Annecy, France

[73] Assignee: Etablissements Francois Salomon et Fils, Annecy, France

[21] Appl. No.: 734,331

[22] Filed: Oct. 20, 1976

[30] Foreign Application Priority Data

Nov. 26, 1975 [FR] France ..... 75 36185

[51] Int. Cl.[2] ..... A63C 9/08

[52] U.S. Cl. ..... 280/624; 280/625

[58] Field of Search ..... 280/624, 625, 626, 629, 280/630, 631, 632

[56] References Cited

U.S. PATENT DOCUMENTS

| | | | |
|---|---|---|---|
| 3,836,163 | 9/1974 | Hashioka | 280/632 |
| 4,049,290 | 9/1977 | Salomon | 280/624 |

*Primary Examiner*—Robert R. Song

*Attorney, Agent, or Firm*—Pollock, Vande Sande & Priddy

[57] ABSTRACT

The binding comprises two moveable lateral jaws connected to a slide adapted to move longitudinally upon the ski. The slide is urged into the retracted position by a release spring. In the release position, with the jaws open, the slide is locked by means of hooks associated with a pedal cooperating with recesses in the slide. The binding permits a "step-in" refitting operation.

30 Claims, 31 Drawing Figures

SAFETY BINDING FOR SKI-BOOT WITH AUTOMATIC REFITTING

The present invention relates to a safety binding designed to retain a ski boot, more particularly to a binding comprising two jaws arranged symmetrically on each side of the longitudinal axis of the ski, and adapted to move, in relation to the ski, in cooperation with the lateral edges of the boot, the jaws being displaceable in the plane of the ski.

Bindings of this type are well known, such as those described in French Pat. No. 1,411,638 and French Pat. No. 2,021,237. These bindings have numerous advantages.

To be specific, they make it possible to eliminate conventional front stops and heel-pieces, since the bindings themselves fulfill all of the functions of these components. Moreover, the elimination of the front stop allows the boot to be completely released, in the longitudinal direction of the ski, in the event of a safety release of the binding according to the invention.

However, this known type of binding, which may be referred to as a "side-jaw binding", does not provide for automatic refitting of the ski after an intentional or a safety release.

In these side-jaw bindings, a resilient element, more particularly a spring, applies a load to the jaws, thus placing them in contact with the boot, and the jaws open against the action of the resilient element. Now any release of this type of known binding unloads the resilient element after the boot has been released. Thus, when the skier wishes to refit the ski, he must carry out a certain number of operations in order to reload the binding. These operations are awkward and may easily cause accidents, especially in the case of the inexperienced skiers.

It is the purpose of the present invention to overcome the disadvantages of conventional side-jaw bindings.

The invention therefore relates to a safety binding designed to hold a boot to a ski and comprising:

a baseplate secured to the ski;

two jaws which are mobile in relation to the baseplate and are arranged symmetrically on each side of the longitudinal axis of the ski, the jaws being designed to cooperate with the lateral edges of the boot and being displaceable in the plane of the ski; and a resilient element which is mounted upon the baseplate and applies a load to the jaws, placing them in contact with the boot, the jaws opening against the action of the resilient element.

The binding it comprises means for keeping the resilient element locked in the compressed condition after the jaws have been opened intentionally or by a safety release. As a result of this arrangement, the binding remains in the open position after the boot has been released, and is thus ready to receive the boot once more, without the need for any operations on the part of the skier, regardless of the type of release (lateral, vertical or of some other kind which has already taken place and is therefore independent of the load applied).

The refitting of the ski is thus greatly simplified.

At the same time, and still with a view to eliminating any operations on the part of the skier, the present invention provides for automatic closing of the binding onto the boot, as soon as the boot is suitably located upon the ski.

According to another characteristic of the invention, the binding comprises, in order to achieve its purpose, an element which senses the presence of the boot upon the ski. Actuation of this element, upon fitting the ski, releases the resilient element and this ensures that the jaws return to the "closed" position.

The element sensitive to the presence of the boot is also retractable and assumes its retracted position when the boot is in place upon the ski. It thus plays no part in any intentional or safety release.

The transmission of the action of the resilient element to the jaws may be achieved by various types of mechanism constituting what is referred to above, in general terms, as the "resilient element".

Thus, according to a first embodiment in which the resilient element comprises, on the one hand, a slide movable in translation in the baseplate and cooperating directly with the jaws in a manner such that its displacement corresponds to the opening or closing thereof and, on the other hand, a spring associated with the slide tending to maintain the latter in a position corresponding to the closed-jaw position, the displacement of the slide takes place against the action of the spring. The means for keeping the resilient element locked in the compressed condition will be in the form of a lock fitted to the baseplate, the slide engaging with the lock when it is in a position corresponding to the opening of the jaws.

In order to be able to cooperate with the lock, the slide will have a housing into which the lock may be hooked.

The lock may with advantage be of a very simple design consisting of a stirrup pivoting about an axis integral with the baseplate, the ends of the stirrup arms being in the form of hooks.

Furthermore, the stirrup is urged permanently towards the slide by means of a spring, the arrangement being such that, when the boot is in place upon the ski, the spring no longer acts upon the stirrup whereas, in the absence of the boot, the spring causes the stirrup to pivot towards the slide.

In this first embodiment, this behavior is made possible by the fact that the end of the stirrup opposite the hooks has a pedal located under the boot.

It will be understood that when the boot is placed upon the ski, the pedal is depressed against the action of the spring, and this simultaneously raises the hooks which are thus moved away from the slide.

To this end, it is desirable for the stirrup spring to be located between the pedal and the baseplate.

Still within the scope of this embodiment, the slide is integral with a threaded rod passing slidingly through a wall upon the baseplate, the rod carrying the spring against the action of which the release of the binding takes place, one end of the spring bearing against the wall on the baseplate, while the other end bears against a spring-tension-adjusting nut on the threaded rod.

On the other hand, the mechanism transferring the action of the jaw-release spring may be of a design in which the resilient element comprises, on the one hand, a slide movable in translation in the baseplate and cooperating with the jaws in a manner such that the displacement of the slide corresponds to the opening or closing of the jaws and, on the other hand, a spring, the action of which is transmitted indirectly to the slide through related parts, with the slide still subjected to the action of the spring which tends to restore it to the position corresponding to the closed jaws.

In this case, and according to a second embodiment of the invention, the action of the spring is applied to the slide through a rocker which cooperates with the slide and which retracts in the event of a safety release, thus releasing the slide and, therefore, the jaws.

During its displacement, the rocker cooperates with a guide profile which is integral with the baseplate and which divides the displacement of the rocker into two phases, namely:

a translating phase during which the rocker remains in contact with the slide, and a pivoting phase, at the end of the translating phase, during which the rocker is separated from the slide and is locked in a retracted position.

With an arrangement of this kind, release of the binding occurs when the rocker passes a release lug carried by the guide profile at the intersection between a horizontal ramp parallel with the ski and a substantially vertical ramp.

In order to facilitate this complex displacement of the rocker, the latter is associated with a cradle hinged to the baseplate, the cradle accommodating slidingly a threaded rod integral with the rocker, the threaded rod receiving the release spring which runs between the cradle and a spring-tension-adjusting nut screwed to the said threaded rod.

In order to facilitate the relative movement between the rocker and the slide, it is desirable for these components to exhibit, respectively, in their cooperating parts, an inclined sliding plane upon which different slopes form between themselves an acute angle.

The inclined plane of the rocker is designed to cooperate, during the translating phase of the slide, with a ridge thereon, whereas the inclined plane of the slide cooperates with a ridge upon the rocker during the vertical displacement phase of the rocker.

In order to ensure automatic refitting and locking of the binding when the boot is in place upon the ski, the rocker cooperates with an element sensitive to the presence of the boot, the function of the element being to ensure, when the ski is being refitted, that the rocker is unlocked, by causing the rocker to pass over the release lug and to make contact again with the horizontal ramp upon the guide profile.

It is desirable for the element sensitive to the presence of the boot to consist of a pedal hinged about a horizontal axis upon the baseplate, the pedal and the rocker cooperating by means of a ramp system which provides for relative movement between these components under satisfactory conditions of friction.

According to a third embodiment, cooperation between the pedal and the rocker is by means of a flap pivoting about a horizontal axis upon the pedal, the flap being kept in contact with the rocker by means of a spring and its movement being restricted by the fact that it bears against a projection upon the baseplate.

The pedal itself may, with advantage, be urged towards the raised position by the spring.

Finally, it will be observed that the device according to the invention is equipped, in all cases, with a lever for removing the ski intentionally, the lever being arranged to pivot either directly upon the slide, or upon a moving part cooperating therewith, depression of the slide always moving it into the position corresponding to the open jaws.

Movement in translation of the base of the ski-removal lever is effected in that the lever cooperates with a ramp carried upon the baseplate.

A description will now be given of three nonrestrictive examples of embodiment of the invention, in conjunction with the drawings attached hereto, wherein.

Figure 1:
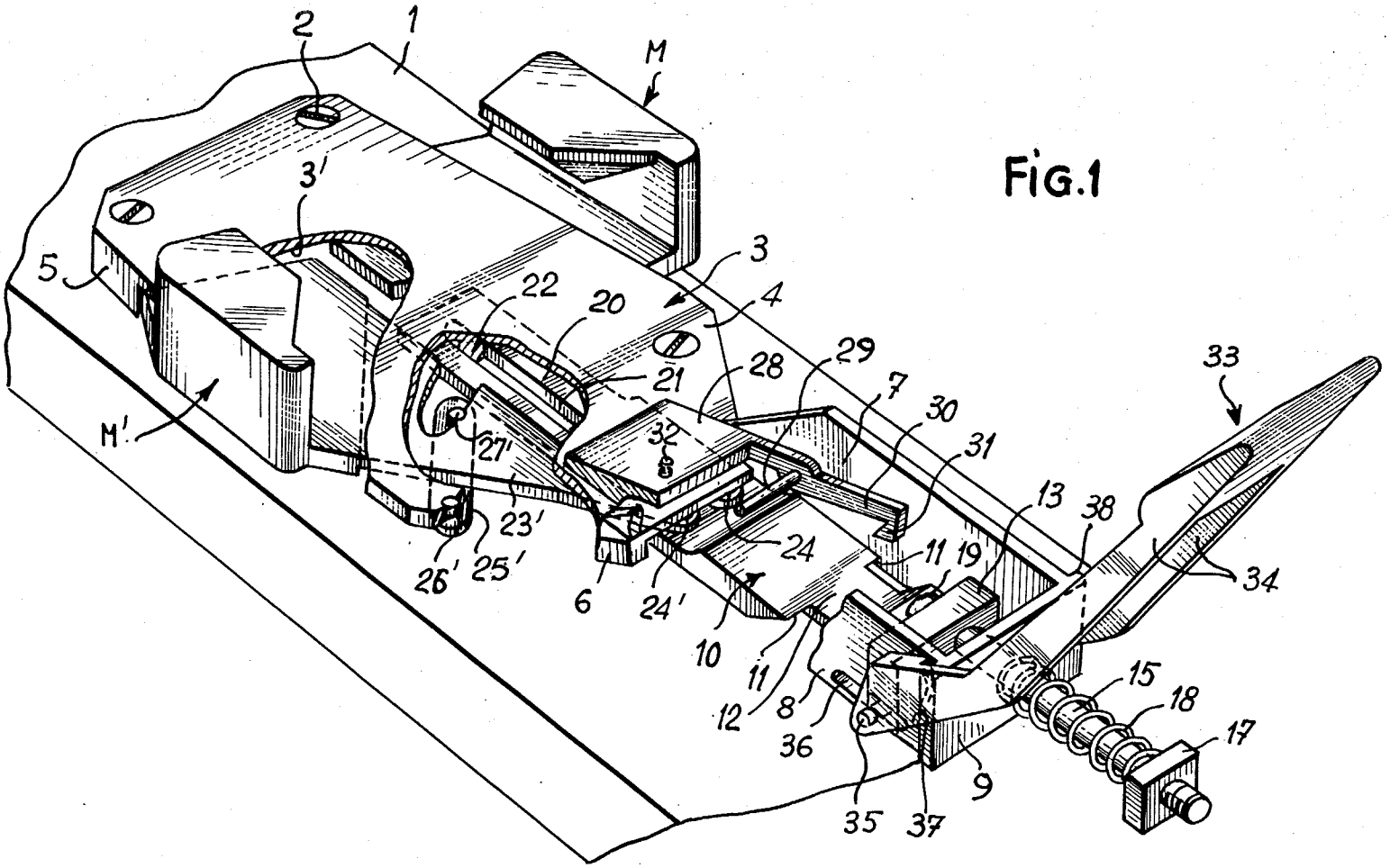
FIG. 1 is a broken-away perspective view showing a first embodiment of the invention, in which the jaws are shown "closed"

A description will first be given of the first embodiment of the invention, with reference to FIGS. 1 to 7.

Secured to a ski 1, by means of screws 2, is a baseplate 3 extending along the longitudinal axis of the ski. This baseplate, the upper surface of which is flat, is in contact with the ski through a front edge 5 and two sides 6, so that bottom surface 3' of the baseplate is at a distance from the ski and forms therewith a space designed to receive jaws marked in general M,M', together with the control mechanism for these jaws. Baseplate 3 comprises at the rear two vertical sides 7,8 united by a vertical transverse member 9. A slide 10 slides between sides 7,8 and between the ski and baseplate 3, the slide being adapted to move along the longitudinal axis of the ski.

The portion of the slide located between sides 7,8 has two lateral recesses 11 forming, between them, a constricted area 12 terminating in a heel 13 drilled at 14 to accommodate a threaded rod 15 passing through an orifice 16 in transverse member 9 towards the rear of the binding. This threaded rod carries a nut 17 at its outer end, a spring 18 extending between the nut and transverse member.

Figure 2:
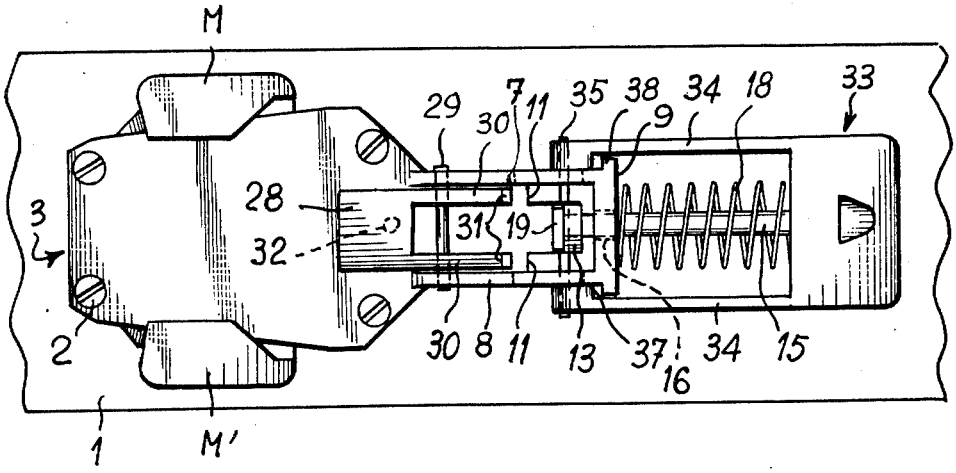
FIG. 2 is a view from above of the binding in FIG. 1.
Figure 3:
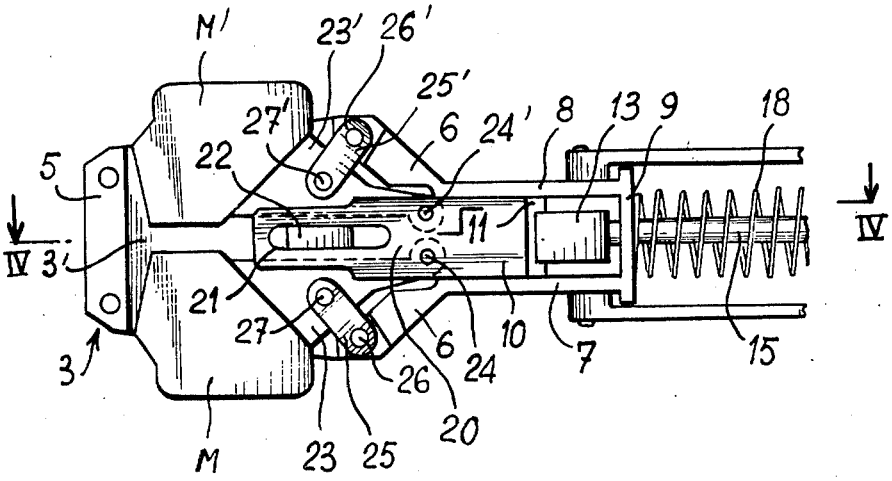
FIG. 3 is a view from below of the binding in FIG. 1, with the ski omitted.
Figure 4:
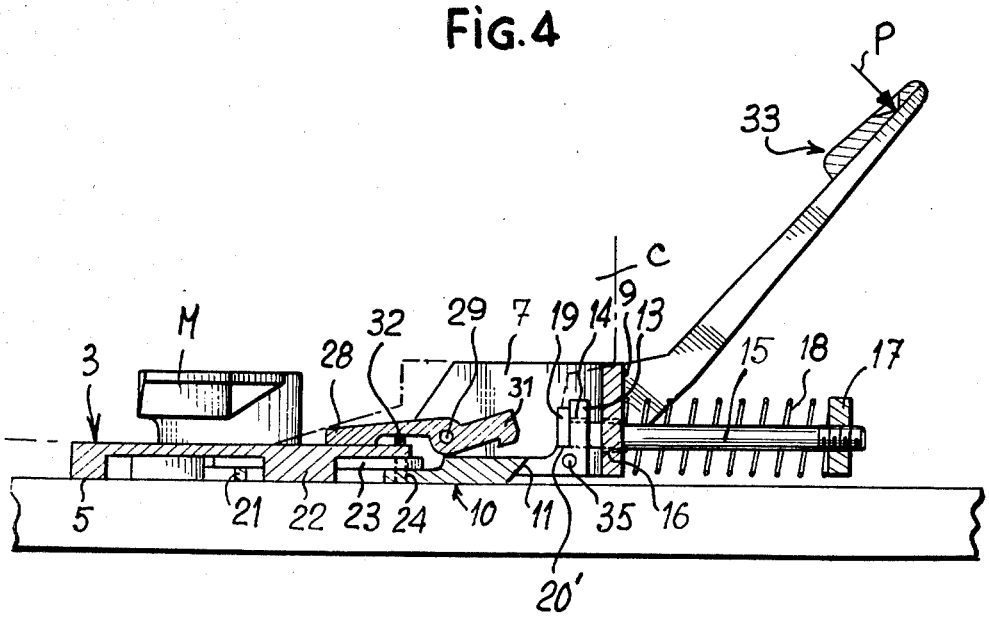
FIG. 4 is a section along the line IV—IV in FIG. 3.

For the purpose of preventing rod 15 from rotating, head 19 thereof has a flat 20' bearing against heel 13 of the slide, the latter thus being urged into the retracted position illustrated in FIGS. 1,2 and 4, by the action of spring 18. At the end remote from heel 13, slide 10 has a tongue 20 with an axial slot 21, the latter engaging with a bar 22 integral with the baseplate and extending, in the central part thereof, towards the ski. In other words, the bar 22 acts as a guide for slide 10 during its longitudinal translation movement.

Jaws M,M' have arms 23,23', the free ends of which are hinged about an axis 24–24' integral with slide 10. Moreover, a link 25–25' connects each jaw to the baseplate, each link being hinged to the baseplate by an axis 26–26' and to the relevant arm of jaws M–M' by an axis 27–27'.

A pedal 28 mounted between sides 7,8 of the baseplate is adapted to pivot about a transverse axis 29 integral with the baseplate. The pedal extends rearwardly in the form of arms 30 (only one of which is shown in FIG. 1) which extend above the slide and which terminate in hooks 31 designed to cooperate with recesses 11 in the slide. Located between baseplate 3 and the pedal is a spring 32 which urges the pedal towards the raised position and thus depresses hooks 31.

The binding is also equipped with a manual ski-removal lever 33, arms 34 of which are hinged about an axis 35 integral with the heel of the slide. Axis 35 runs laterally on each side of the heel, passing through slots 36 in sides 7, 8 of the baseplate. Arms 34 of the ski-removal lever each have a convex ramp 37 bearing against projecting wings 38 of transverse member 9 of the baseplate.

The device described above operates as follows: It will be assumed that the initial position of the device is that illustrated in FIGS. 1 to 4, i.e., with boot C located upon the ski and held by jaws M,M' which are therefore in the closed position. The outline of the heel of the boot is shown in FIG. 1 in dotted lines. This heel is provided so that, with the boot in position, it depresses pedal 28 and bears, at a higher level, upon the edges of sides 7,8 of the baseplate. In this position slide 10 is fully retracted under the action of spring 18, while ski-removal lever 33 is in the raised position.

Figure 5:
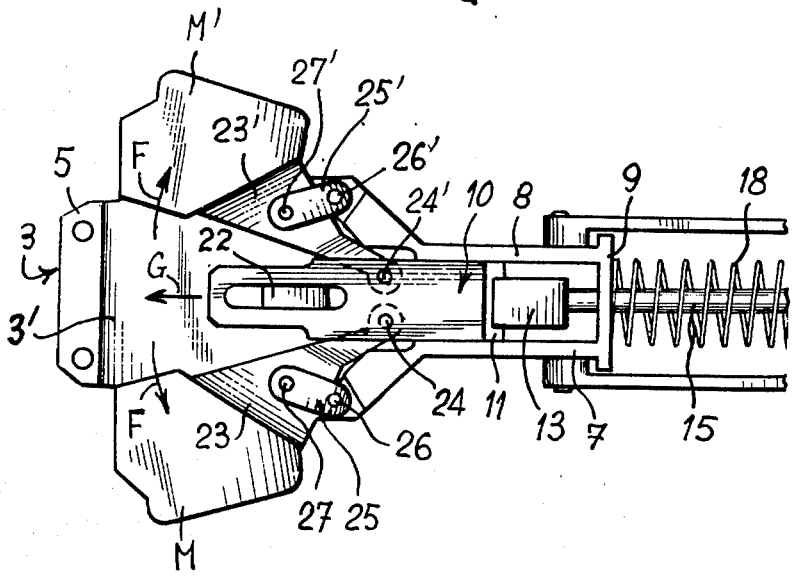
FIG. 5 is a view from below of the binding in FIG. 1, in which the jaws are shown in open position.
Figure 6:
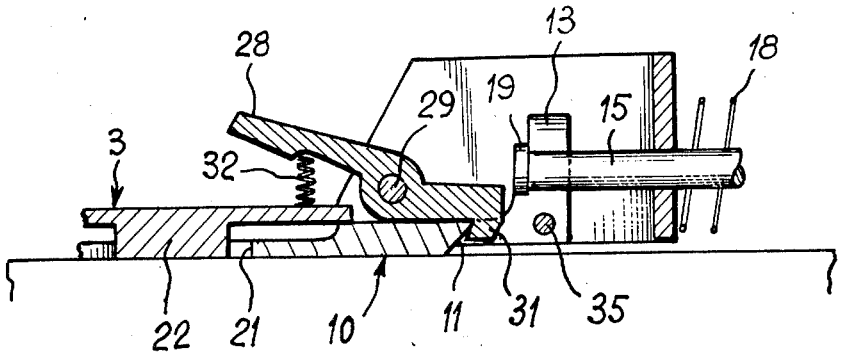
FIG. 6 is a partial view in cross-section, corresponding to FIG. 4, showing the mechanism, but with the slide in the locked position, corresponding to the open position of the jaws shown in FIG. 5.

If a load is applied to jaws M,M' through boot C, the jaws open in the direction of arrows F in FIG. 5, with links 25–25' pivoting about axes 26–26', while slide 10 slides in the direction of arrow G, against the action of spring 18, which is compressed. If the sole of the boot moves sufficiently, pedal 28 straightens up under the action of its spring 32 and lugs 31 engage behind recesses 11 in the slide (FIG. 6). The slide is thus locked in the boot-release position and spring 18 remains loaded.

In order to refit the ski, the skier merely has to step onto the baseplate with his boot, which presents no problem since jaws M,M' are still open. As soon as the heel of the boot comes into contact with pedal 28, the pedal is depressed against the action of its spring 32 and lugs 31 lift, thus releasing slide 10 which returns to its initial position under the action of spring 18. The return movement of the slide closes jaws M,M', and these secure the boot to the ski.

If the skier wishes to remove the ski intentionally, he applies pressure in the direction of arrow P to ski-removal lever 33 (with his ski-pole, for example). The lever then pivots about its axes 35, as a result of cooperation between ramp 37 and transverse member 9. Depressing the lever into the position shown in FIG. 7 causes slide 10 to move forwards against the action of spring 18, thus opening jaws M,M'. The boot is thus released and may be removed from the ski. If the lever is kept depressed, release of pedal 28 causes hooks 31 to snap in behind recesses 11 in the slide, thus restoring the position shown in FIG. 6.

Figure 7:
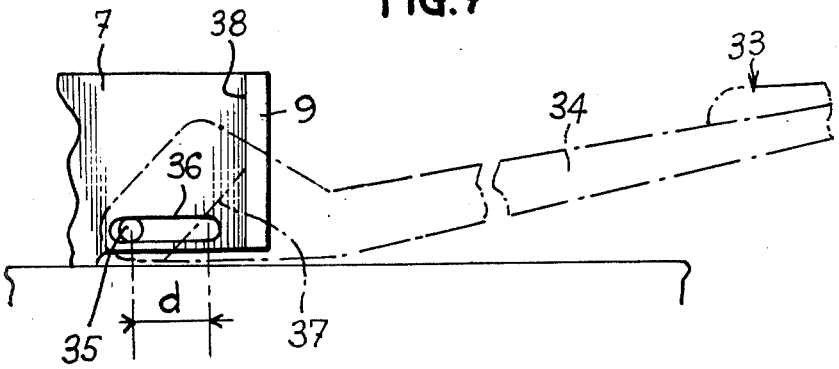
FIG. 7 shows the ski-removal lever in the depressed position corresponding to intentional removal of the ski.
Figure 9:
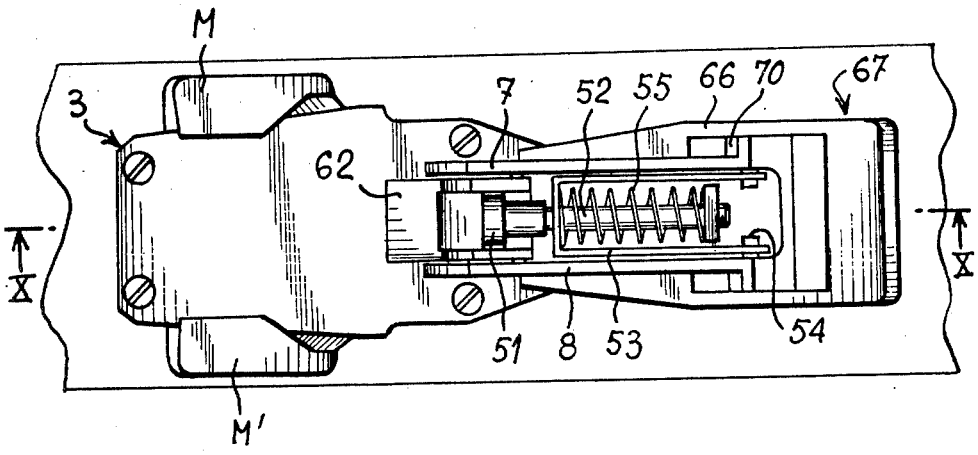
FIG. 9 is a plan view of the binding in FIG. 8.

It will be observed that the ski-removal travel is indicated in FIG. 7 by the displacement "d" of axis 35 in slot 36.

A description will now be given of a second embodiment of the invention, in conjunction with FIGS. 8 to 20.

In this embodiment, similar components bear the same reference numerals as in FIGS. 1 to 7.

Jaws M,M' are hinged by their arms 40 about vertical axes 41 in housings 42 arranged on the sides of slide 10. Arms 40 also bear upon a ramp 43 upon baseplate 3 which serves as a guide for the jaws while they are opening and closing. This is a conventional arrangement such as disclosed in U.S. patent application Ser. No. 611,419 filed on Sept. 8th, 1975, and it will therefore not be described in detail.

As in the foregoing embodiment, slide 10 has a front tongue 44 fitted with a slot engaging a projection 45 upon the baseplate for the purpose of guiding the slide specifically in the direction of the longitudinal axis of the ski. At the end remote from tongue 44, the slide has a heel 46 running upwardly and having an upper part which is trapezoidal in section and has two lateral wings 47 sliding in a slot 48 in each of the vertical slides extending the baseplate rearwardly. Slot 48 has one substantially horizontal part extended towards the front by an upwardly sloping recess 49. At the intersection between upper horizontal ramp 48' on the slot and rear ramp 49' on the recess 49, there is a release lug 50, the function of which will be explained hereinafter.

Located ahead of heel 46 is substantially vertical rocker 51, lateral extremities 52 of which are also housed slidingly in slot 48. This rocker is integral with a threaded rod 52 sliding in a stirrup 53 adapted to pivot about axes 54 between sides 7,8 of the baseplate. Mounted upon that part of threaded rod 52 located within the stirrup is a spring 55 and an adjusting nut 56, the spring being thus held between the front of the stirrup and the nut, and the tension thereof being adjustable by displacing nut 56 upon the threaded rod. It will be understood that, with this arrangement, rocker 51 is applied by the action of spring 55 to heel 46 on slide 10, the latter being thus held in its retracted position. The lower part of rocker 51 has a chamfered surface 57 which, in the position illustrated in FIGS. 8,10,11,17, bears against a ridge 58 located at the intersection of a vertical plane 59 and sloping surface 60 of the heel.

Moreover, a U-shaped pedal 62 is mounted to pivot about an axis 61 between sides 7,8 of the baseplate, the arms of the pedal cooperating, by their lower edges 63, with rocker 51.

Figure 11:
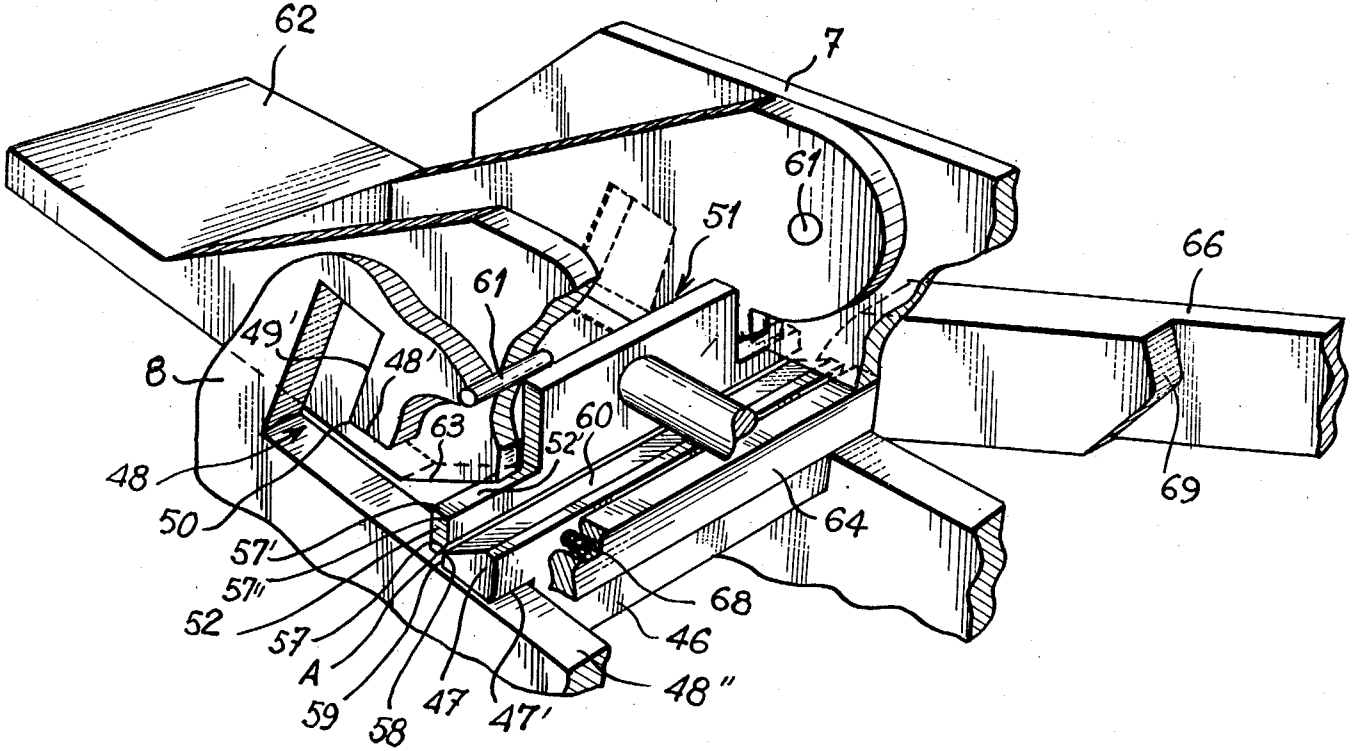
FIG. 11 is a perspective, to an enlarged scale, of a part of the binding.
Figure 13:
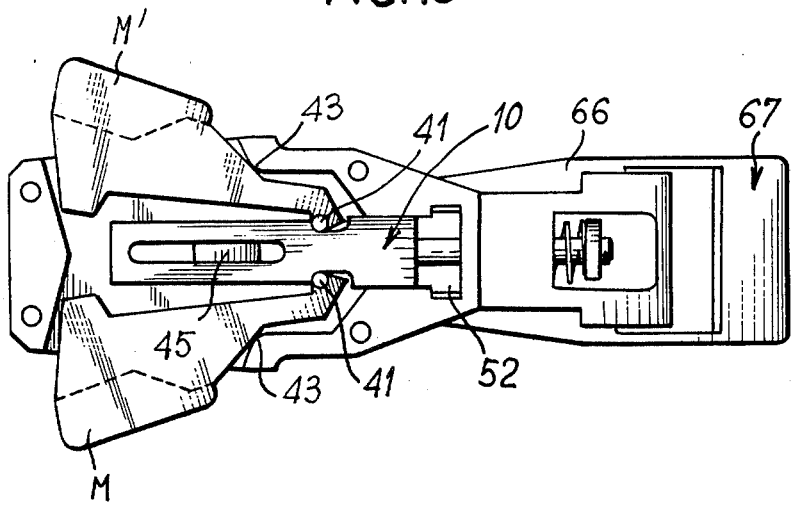
FIGS. 13 and 14 are views of the binding from below showing, respectively the jaws partly open and fully open.
Figure 14:
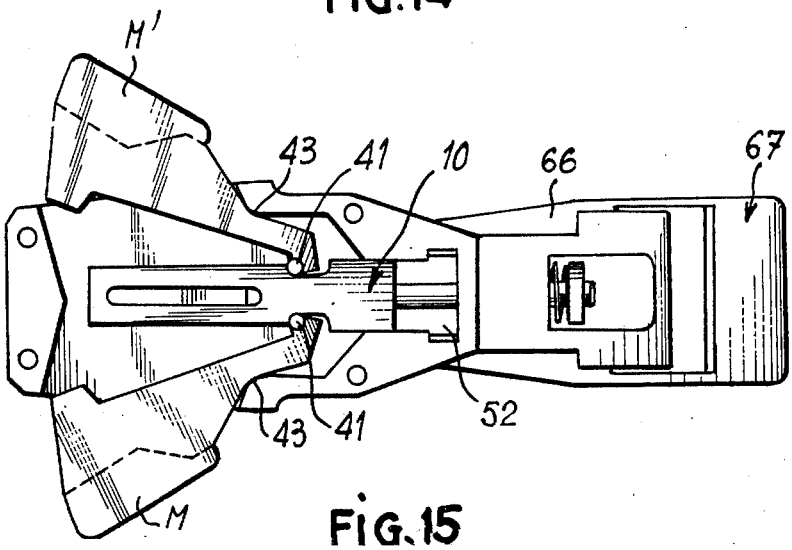
Figure 15:
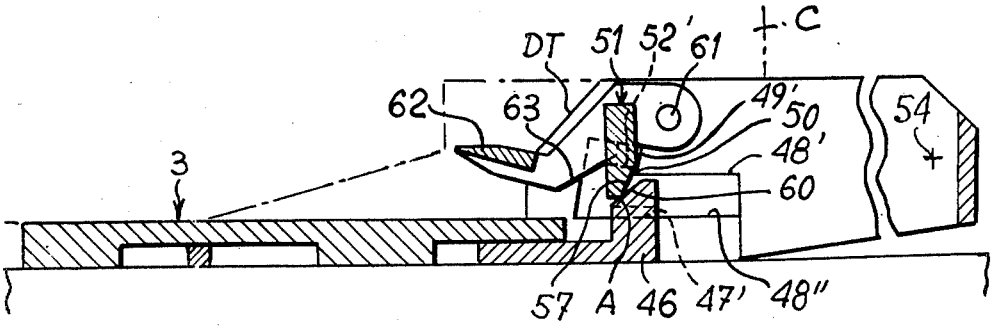
FIGS. 15,16,17 show different positions of the rocker and the slide cooperating either at the moment of a lateral release or when the binding is being secured to the boot.

Finally, a bar 64 with a cross-section substantially in the form of a parallepiped is also mounted slidingly in slot 48 and to the rear of heel 46. This bar has two terminal axes 65 to which are hinged the ends of arms 66 of a ski-removal lever marked generally with the reference numeral 67. Small springs 68 are interposed between bar 64 and heel 46 (FIG. 11).

Located along the length of arms 66 of ski-removal lever 67 are ramps 69 contrived on the arms and designed to cooperate with corresponding ramps 170 arranged at the ends of sides 7,8 of the baseplate.

Figure 8:
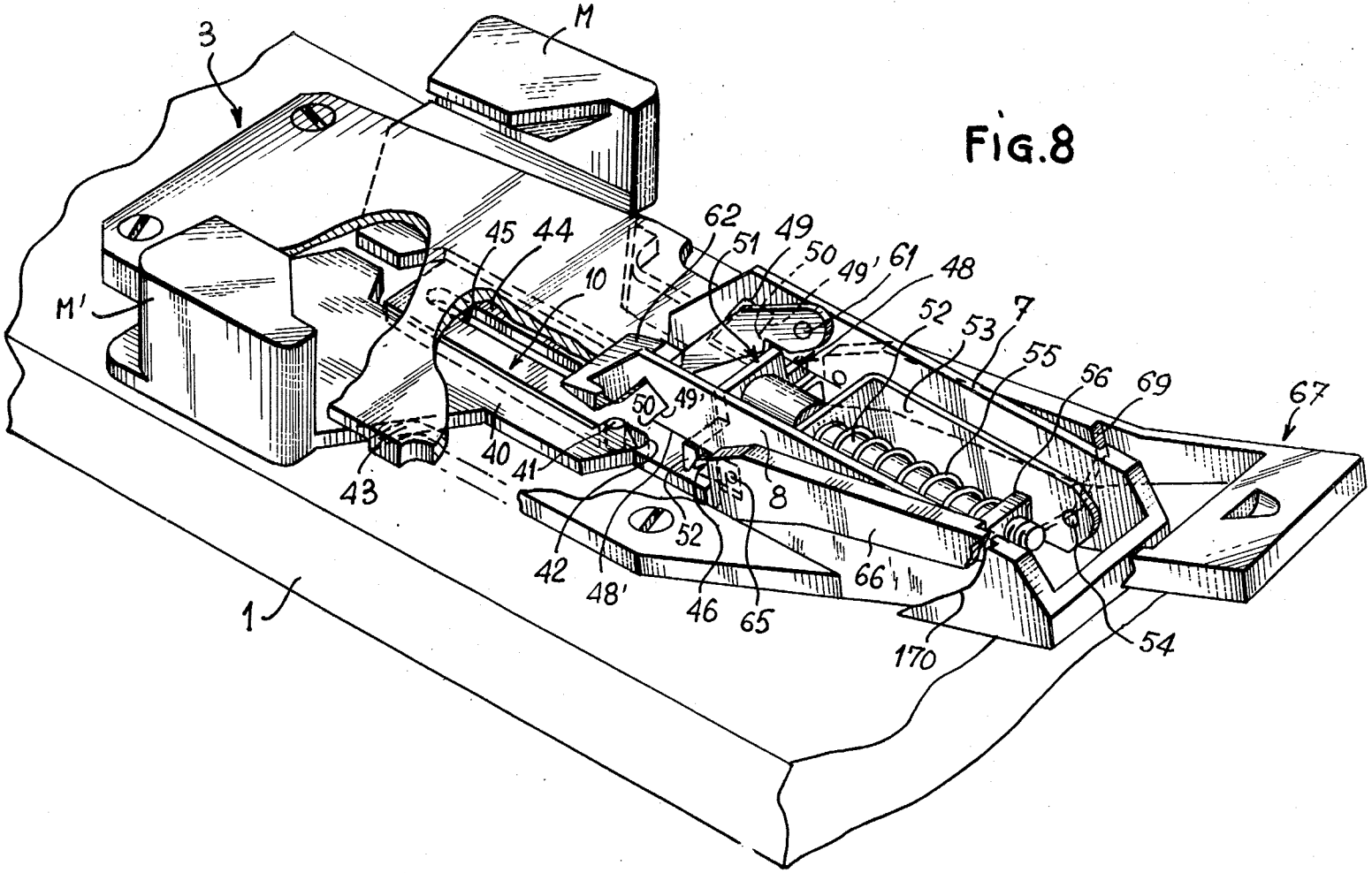
FIG. 8 is a perspective of a second embodiment according to the invention, with certain parts broken away and the jaws in the closed position.
Figure 10:
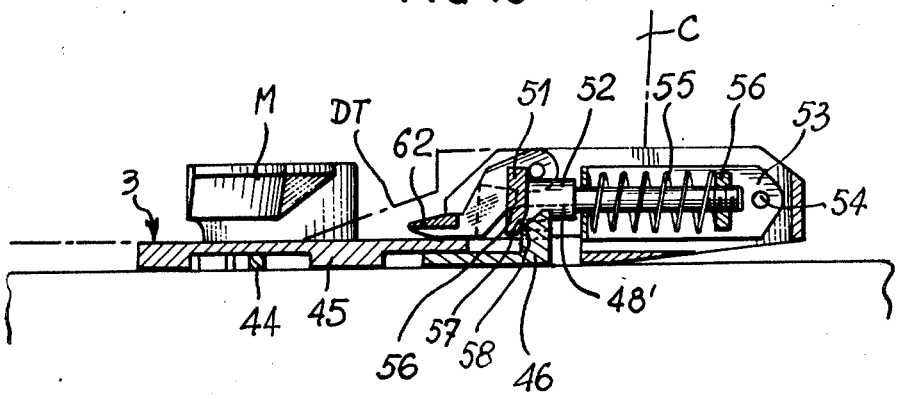
FIG. 10 is a section along the line X—X in FIG. 9.
Figure 12:
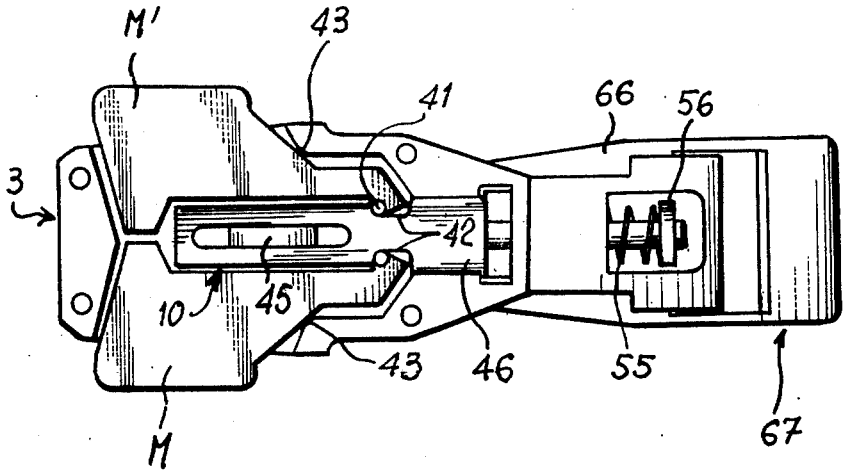
FIG. 12 is a view from below with the jaws in the closed position, with the ski omitted.

It will be assumed that the starting position for the binding is that shown in FIGS. 8 and 10. In this position the contour of the heel of boot C, shown in dotted lines in FIG. 10, shows that the latter is resting upon the upper parts of sides 7,8 of the baseplate. The binding is locked in the position in which the boot is held. In the event of a lateral or vertical movement of boot C, under the action of a load resulting from a fall, the boot spreads jaws M,M' apart, which causes slide 10 to move forward against the action of spring 55. Heel 46 of the slide pushes rocker 51 forward, the rocker sliding within slot 48 and this thrust against the rocker being assured by ridge 58 on the heel 46 in contact with chamfered surface 57 of the rocker. This thrust against chamfered surface 57 applies to the rocker a force having a vertical component which is transmitted, on the one hand, to upper ramp 48' of the groove by upper surface 52' of lateral wings 52 of the rocker and, on the other hand, to lower edge 48" of the groove by lower surface 47' of the wings of the heel located in the groove. When the rocker reaches and passes release lug 50, the safety release occurs (FIG. 15), the rocker tending, under the action of the vertical component, to rotate about hinge axes 54 of stirrup 53, and to slide into vertical housing 49 of the slot. The rocker is thus locked in the slot. It will be observed that since rear ramp 49' of the vertical housing slopes slightly to the rear, it allows slight decompression of the spring, so that the pivoting movement of the rocker is produced solely by the action of release spring 55. Thus the energy which produced the release is stored (FIG. 16).

Figure 16:
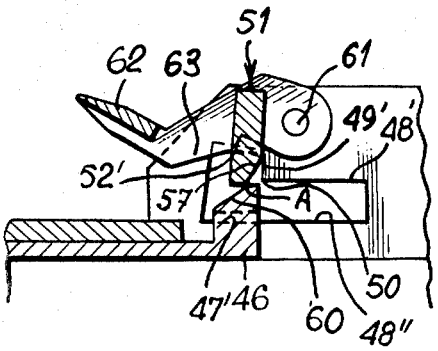

In the position illustrated in FIG. 16, it may be seen that the rocker leaves the horizontal area of groove 48 entirely free, while allows the heel of the slide to move freely forward, thus making total opening of the jaws possible. It will also be observed that the pivoting of rocker 51 causes pedal 62 to rise; the heel of the boot is also relieved in order to avoid any collision between the pedal and the heel in the event of a purely lateral release, i.e., when the boot is displaced in parallel with the ski. This relief which appears in the figures in the form of a chamfer DT, is uniform all across the boot in the example illustrated. It is obvious, however, that it could also be of any other appropriate configuration, especially of an evolutionary shape symmetrical in relation to the longitudinal axis of the boot.

Figure 17:
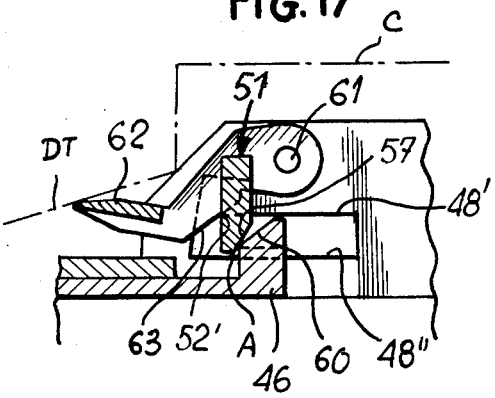

The binding being in the position shown in FIG. 16, it is then closed onto the boot as follows: pressure is applied to pedal 62 with the sole of the boot. The rear edges 63 (FIG. 17) of the arms of the pedal bear slidingly upon front ridge 57' of the rocker, obliging the latter to slide down along ramp 49' of the slot. During this movement, lower ridge A of the rocker, which bears against sloping plane 60 of the heel, pushes the slide to the rear until ridge 57" of the rocker moves downwardly past lug 50 of the slot (FIG. 17). The rocker is thus locked and spring 55 is decompressed, carrying both the rocker and slide 10 completely to the rear. The jaws thus close again to the position holding the boot.

Figure 18:
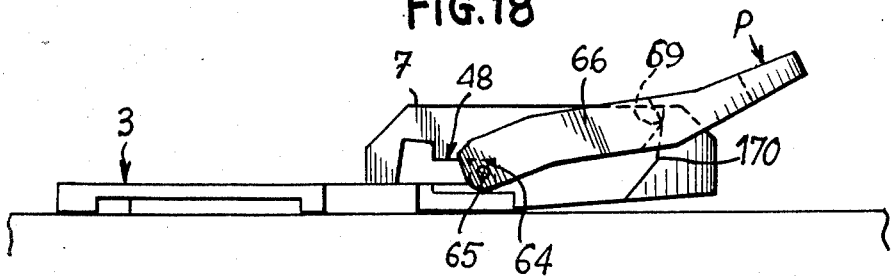
FIGS. 18,19,20 show three positions of the ski-removal lever in action.
Figure 19:
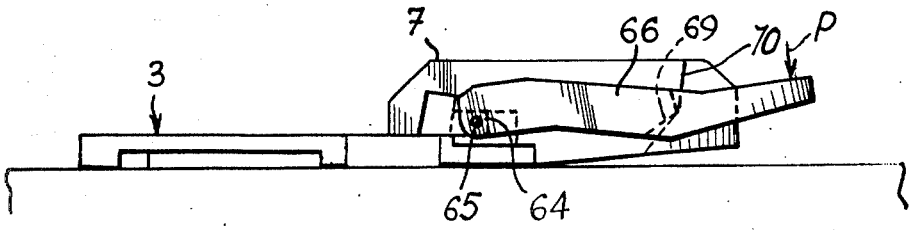
Figure 20:
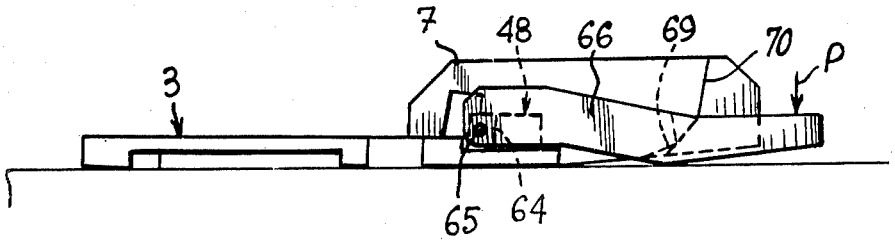
Figure 21:
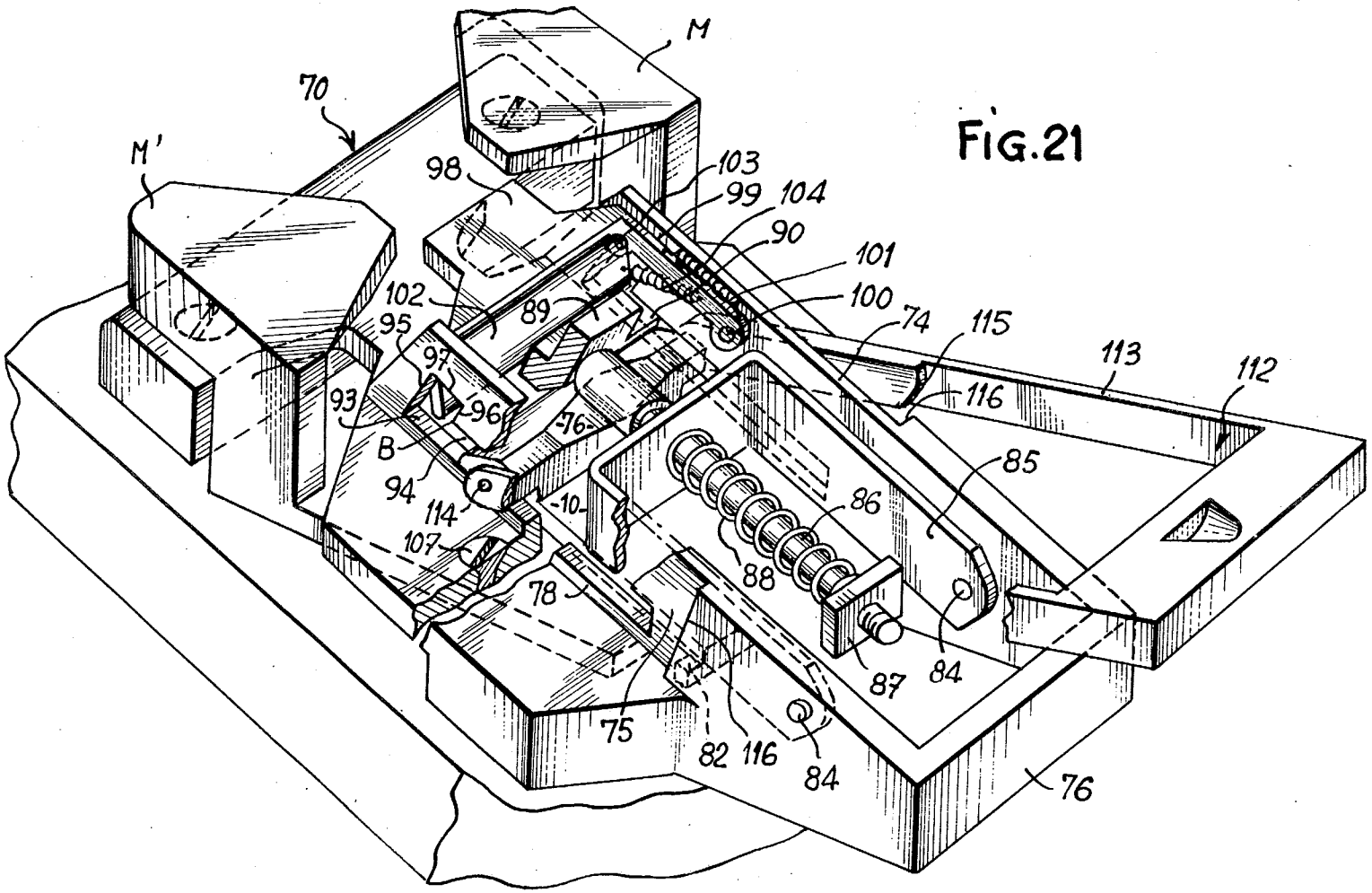
FIG. 21 is a partly broken-away perspective of a third embodiment of the invention, the jaws being shown in the closed position.
Figure 22:
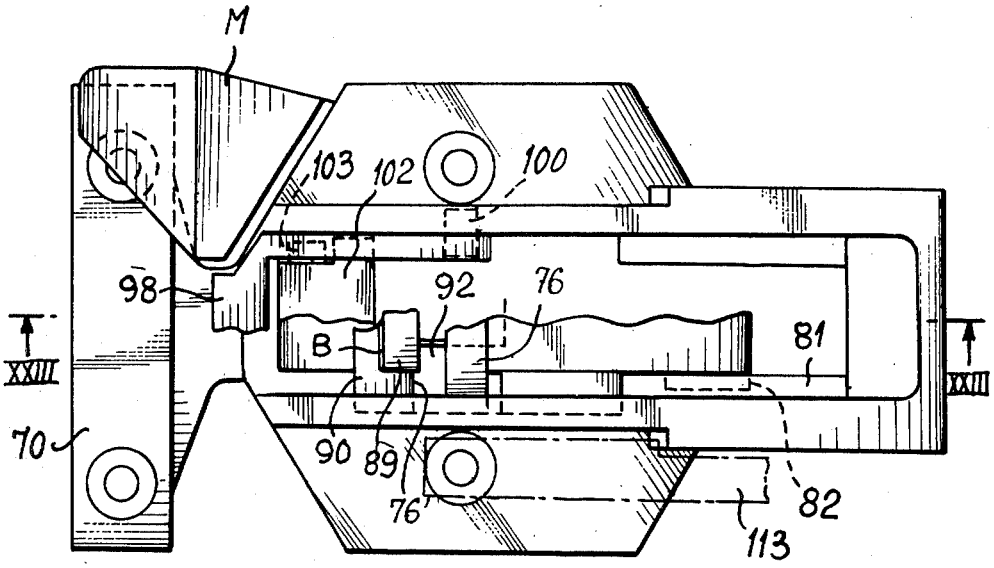
FIG. 22 is a plan view of the binding in FIG. 21.
Figure 23:
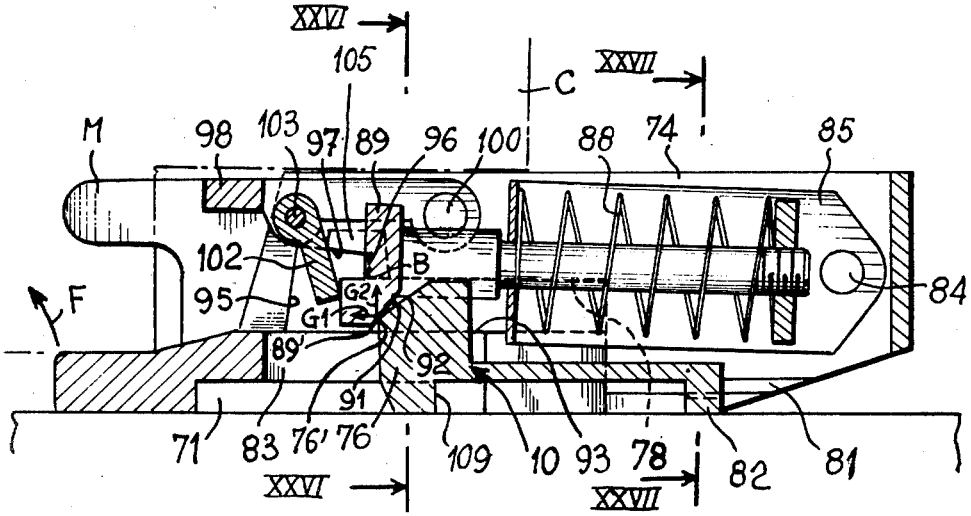
FIG. 23 is a section along the line XXIII—XXIII in FIG. 22.

Intentional opening of the binding is illustrated more particularly in FIGS. 18 to 20. With the binding in the position shown in FIG. 18, this operation is carried out by applying pressure in the direction of arrow P (with a ski-pole, for example) to ski-removal lever 67, causing the lever to rotate downwardly about its axes 65, and causing ramps 69 to move upon corresponding ramps 170 of the baseplate. This displacement causes bar 64 to slide forwards in groove 48. Bar 64 now bears against the back of heel 46, moving the heel forwards until release is achieved in the manner described above in the case of a fall.

It will be observed that small springs 68, located between bar 64 and heel 46, keep the ski-removal lever raised when the binding is in the condition shown in FIGS. 8 and 10.

Figure 26:
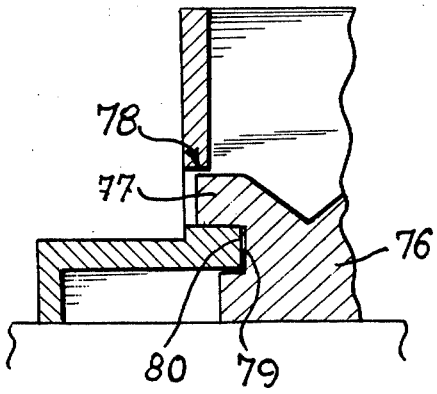
FIGS. 26,27 are partial sections along the lines XXVI and XXVII in FIG. 23.

In this embodiment, the lower part of the baseplate, marked 70 as a whole, is recessed to provide, in conjunction with ski 1, a housing 71 designed to receive jaws M,M' and slide 10. Baseplate 70 is thus in contact with the ski through a forward surface 72 and two lateral surfaces 73. The upper part of the baseplate also has two vertical walls 74,75 united by a rear transverse member 76. The front of slide 10 has a head 76 comprising two lateral wings 77 (FIG. 26), of substantially trapezoidal section and housed slidingly in grooves 78 in each of walls 74,75.

Figure 27:
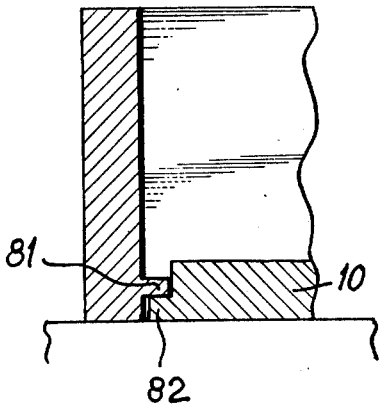

Head 76 also has two lateral grooves 79 engaging with slides 80 upon the baseplate, this assembly making it possible to provide a suitable guide for the front part of the slide. Similarly, the rear part of the slide runs on guides 81 on walls 74,75 of the baseplate (FIG. 27). To this end, the rear part of the baseplate has extensions 82 fitted under guides 81.

The central area of the baseplate is, of course, provided with a longitudinal aperture 83 in which head 76 of the slide is accommodated and moves. Hinged about axes 84, between walls 74,75 of the baseplate, is a U-shaped stirrup 85, through the transverse member of which there slides a threaded rod carrying at one end a nut 87 which adjusts a spring 88 compressed between the nut and the transverse member of the stirrup. The front part of rod 86 is integral with a rocker 89 of substantially J-shaped cross section. Rocker 89 has two lateral wings 90 designed to cooperate with slot 78 as will be explained hereinafter. The lower part of rocker 89 cooperates with head 76 of slide 10, to which end the lower part has a sloping surface 91, whereas the upper part of head 76 of the slide has sloping surface 92, the surfaces 91,92 being such as to form an acute angle between themselves. The slots contrived in walls 74,75 of the baseplate have a lower surface 93 and an upper surface 94. Located at the front of each of the slots is a substantially vertical recess, walls 95,96 of which extend upwardly and are united by a sloping edge 97. The intersection of surfaces 94,96 of the groove define a release lug B, the function of which will also be explained hereinafter.

A pedal 98, comprising two lateral arms, is hinged at 100 to the inside of walls 74,75 of the baseplate, the pedal being urged with advantage into the raised position by means of spring 101. Moreover a pivoting flap 102 is hinged about axes 103 between arms 99 of the pedal. A spring 104, located between the flap and the pedal tends to cause the flap to pivot in an anti-clockwise direction, towards rocker 89, against the end of which the flap is caused to bear.

It will be observed that stops 105 are provided inside walls 74,75 of the baseplate, upon a level with edges 96,97 of the groove, the purpose of the stops being to limit the release of flap 102, as will be described hereinafter.

Figure 24:
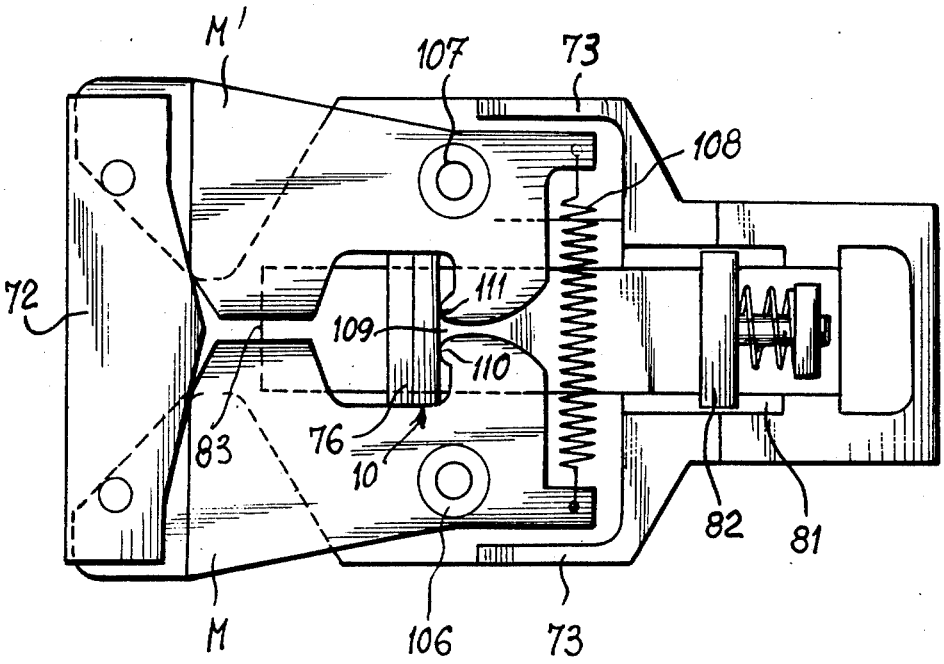
FIGS. 24,25 are views of the binding in FIG. 21 from below, showing the jaws in the closed and open positions respectively.

Finally, and as may be seen more particularly in FIG. 24, jaws M,M' are hinged about vertical pivots 106,107 respectively, the jaws being urged into the open position by a spring 108 located between the ends of the jaws located inside the baseplate. Moreover, lower part 109 of head 76 of the slide bears against rounded noses 110,111 on the jaws.

Finally, the binding according to this third embodiment is equipped with a manual ski-removal lever 112 in the form of a stirrup. The free ends of arms 113 of the lever are hinged at 114 to the sides of wings 77 of slide 10. Arms 113 have centrally located ramps 115 designed to cooperate with corresponding ramps 116 contrived in walls 74,75 of the baseplate.

A description will now be given of the manner in which the binding according to FIGS. 21 to 31 operates.

Figure 25:
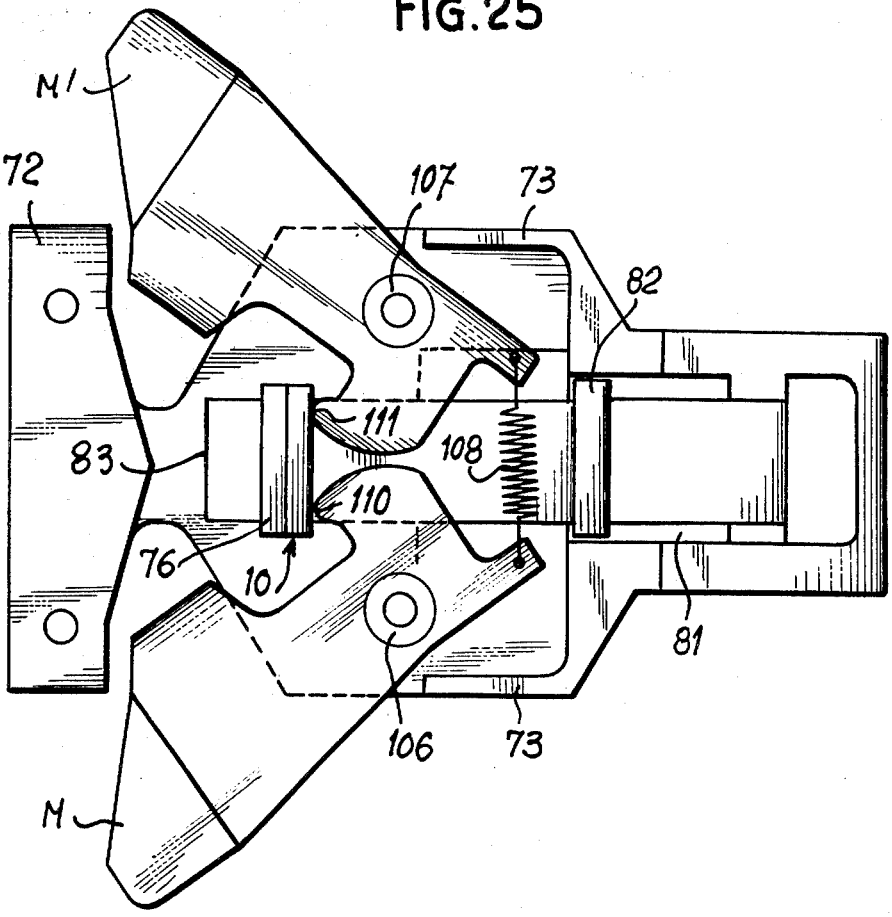

The starting position of the binding will be assumed to be that illustrated in FIG. 25, in which boot C, the contour of which is indicated in dotted lines, is kept in position upon the ski by jaws M,M' which are closed, and slide 10 being in the retracted position under the influence of rocker 89 which is urged rearwardly by spring 88.

In the event of a forward fall, boot C is lifted in the direction of arrow F (FIG. 23), and jaws M,M' now open by rotating about pivots 106,107, this movement being assisted by spring 108. Noses 110,111 on the jaws push head 76 of the slide forward, causing it to slide in slot 78. Forward ridge 76' of the head of the slide, which bears against inclined surface 91 of the rocker, transmits to the latter a force having:

on the one hand, a horizontal component according to arrow $G_1$, on the other hand, a vertical component $G_2$.

Component $G_2$ applies wings 90 of the rocker to edge 94 of slot 78, thus preventing the rocker from pivoting about axes 84. On the other hand, component $G_1$ causes rocker 89 to move in translation against the action of spring 88. At the same time, flap 102 is moved in a clockwise direction.

When the rocker passes release lug B in slots 78, component $G_2$ causes rocker 89 to pivot upwardly by rotation of stirrup 85 about axes 84. This produces the position shown in FIG. 31. Lower ridge 89' of the rocker then slides along sloping surface 92 of the slide and the latter moves as long as the jaws are not fully open.

Figure 31:
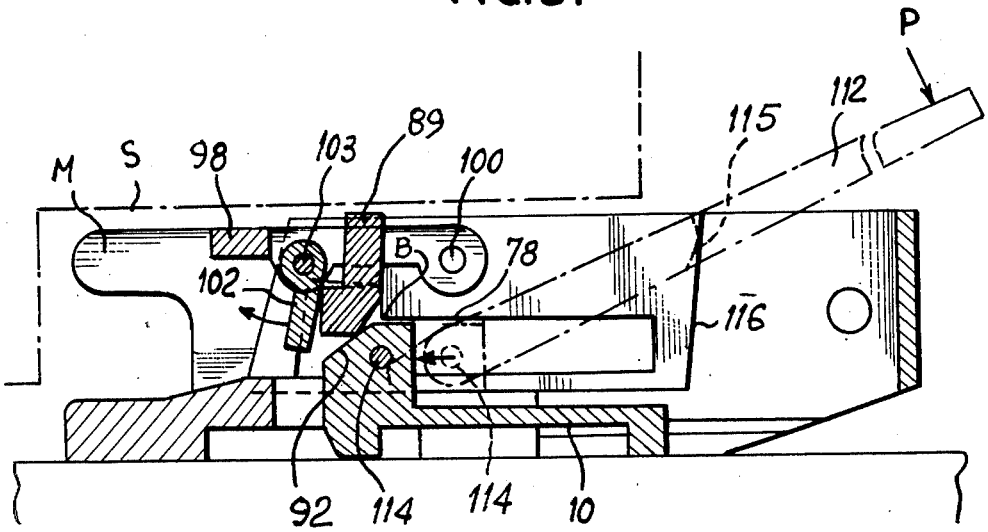
FIG. 31 is a partial section showing the position of the elements in the event of lateral release.

As may be seen more particularly in FIG. 31, the rocker is locked behind edge 96 of slot 78. The slide, no longer subjected to the action of spring 88, is kept in the advanced position by the thrust applied by noses 110,111 of the jaws, which are kept open by the action of their spring 108.

Figure 29:
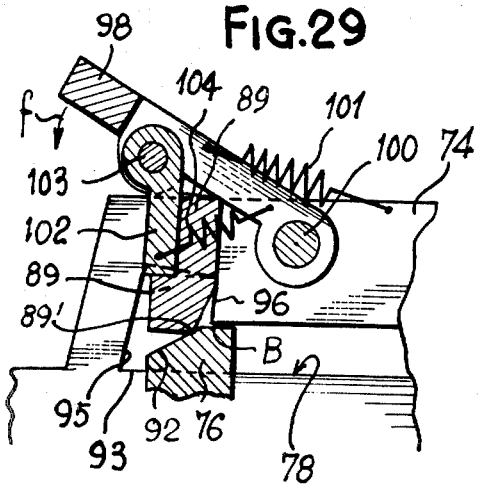
FIGS. 28,29 show the refitting pedal in two different positions.
Figure 28:
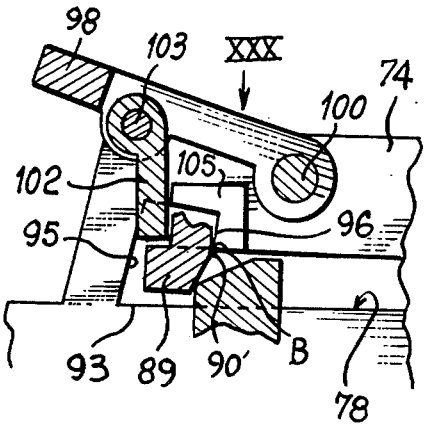
Figure 30:
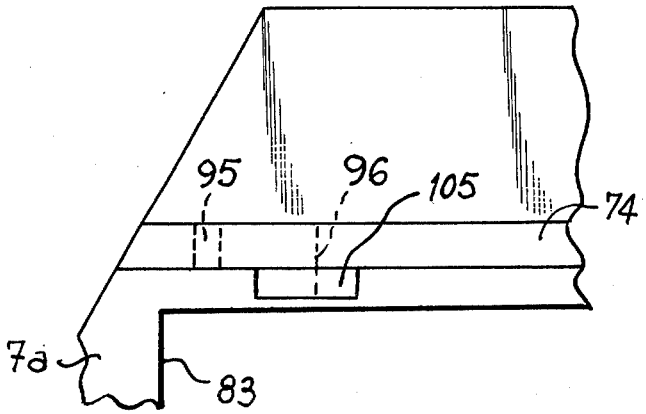
FIG. 30 is a view in the direction of arrow 30 in FIG. 28.

It will be observed, more particularly in FIG. 29, that pedal 98 is raised by its prings 101 as soon as the boot has been released from the binding.

Oscillating flap 102 is furthermore locked in the shoulder upon the front of rocker 89.

In order to refit the ski, the boot is applied to pedal 98 in the direction of arrow "f" in FIG. 29. Rotation of the pedal about its axis 100 depresses flap 102 and this applies a thrust towards the bottom of rocker 89. The latter slides along edge 96 of the slot, pushing slide 10 to the rear by means of ridge 89' sliding upon sloping surface 92 of the slide.

When rear ridge 90' of the rocker wings passes release nose B, the rocker is returned by spring 88. This applies a thrust to slide 10 and causes the jaws to close against the action of spring 108. In order to prevent flap 102 from moving too far back, the flap comes up against stops 105, thus keeping it in the position shown in FIG. 23.

It will be observed that in the event of a lateral release, i.e. when the boot is displaced in the plane of the ski (FIG. 31), pedal 98 cannot pivot upwardly since it comes up against lower surface S of the heel of the boot. Rocker 89 therefore moves flap 102 forward against the action of its spring 104. This displacement of the flap allows the rocker to lock itself in the upper part of slot 78, as described above, and the release occurs as indicated in conjunction with FIG. 29. As soon as the boot releases pedal 98, the latter straightens up and flap 102 comes to rest in the front shoulder of the rocker, under the influence of spring 104.

All that the skier has to do to remove the ski intentionally is to apply pressure, in the direction of arrow P, to ski-removal lever 112. Depression of this lever causes a displacement of ramps 115, on the lever, upon ramps 116 of the baseplate. Since the end of the lever is connected at 114 to the head of slide 10, this causes the slide to move in translation in the baseplate. As already explained, the slide then applies a thrust to the rocker which locks itself in the upper part of slot 78. The jaws are now free to open under the action of their spring 108.

What is claimed is:

1. A safety binding to hold a boot to a ski and comprising:

(a) a baseplate secured to the ski;

(b) two jaws adapted to move in relation to said baseplate and arranged symmetrically on each side of the longitudinal axis of the ski, said jaws being designed to cooperate with the sides of the boot and being displaceable in the plane of the ski;

(c) a resilient means mounted on said baseplate and including (i) a slide element mounted to move in translation in said baseplate and to cooperate with said jaws, in such a manner that the displacement of said slide corresponds to the opening or closing of said jaws; and (ii) a spring means associated with the slide element and tending to retain the latter in a position corresponding to the closed jaws, the displacement of said slide occurring against the action of said spring means, said slide being adapted to move between a first position corresponding to the closing of said jaws and a second position corresponding to the opening thereof; and (d) a lock means on said baseplate engaging one of the elements of said resilient means when said slide is in its second position.

2. A binding according to claim 1, further comprising an element sensitive to the presence of the boot upon the ski, the action of said element ensuring the release of said element engaged by the lock when the ski is fitted to the boot.

3. A binding according to claim 2, wherein said element sensitive to the presence of the boot is retractable when the boot is in place upon the ski, said element therefore playing no part in intentional or safety releases.

4. A safety binding designed to hold a boot to a ski and comprising:

a baseplate secured to the ski;

two jaws adapted to move in relation to said baseplate and arranged symmetrically upon each side of the longitudinal axis of the ski, said jaws being designed to cooperate with the sides of the boot and being displaceable in the plane of the ski, and a resilient element mounted upon said baseplate and including:

a slide adapted to move in translation in said baseplate and to cooperate with:

said jaws, in such a manner that the displacement of said slide corresponds to the opening or closing of said jaws, and a spring associated with the slide and tending to keep the latter in a position corresponding to the closed jaws, the displacement of said slide occurring against the action of said spring, and said slide being adapted to move between a first position corresponding to the closing of said jaws and a second position corresponding to the opening thereof, said baseplate being equipped with a lock with which said slide engages when in its second position.

5. A binding according to claim 4, wherein said slide comprises a housing for cooperation with said lock.

6. A binding according to claim 5, wherein said lock is in the form of a stirrup pivoting about an axis integral with said baseplate, the arms of said stirrup terminating in hooks.

7. A binding according to claim 6, wherein said stirrup is urged towards said slide by a spring.

8. A binding according to claim 7, wherein said stirrup exhibits, at the end remote from said hooks, a pedal sensitive to the presence of the boot, said hooks being lifted when said pedal is depressed.

9. A binding according to claim 8, wherein said spring acting upon the stirrup is located between said pedal and said baseplate.

10. A binding according to claim 5, wherein said slide is integral with a threaded rod passing slidingly through one wall of said baseplate and carrying said spring against the action of which the releases are produced, one end of said spring bearing against the wall of said baseplate and the other end against an adjusting nut screwed to said threaded rod.

11. A safety binding to hold a boot to a ski and comprising:

(a) a baseplate secured to the ski;

(b) two jaws adapted to move in relation to said baseplate and arranged symmetrically on each side of the longitudinal axis of the ski, said jaws being designed to cooperate with the sides of the boot and being displaceable in the plane of the ski;

(c) a resilient means mounted on said baseplate and including (i) a slide element mounted to move in translation in said baseplate and to cooperate with said jaws, in such a manner that the displacement of said slide corresponds to the opening or closing of said jaws; and (ii) a spring means including a rocking portion rotatable relative to said baseplate, said spring means being associated with the slide element and tending to retain the latter in a position corresponding to the closed jaws, the displacement of said slide being adapted to move between a first position corresponding to the closing of said jaws and a second position corresponding to the opening thereof; and (d) a lock means on said baseplate, said lock means being constituted by a guide profile engaging said rocking portion of said resilient means when said slide is in its second position.

12. A binding according to claim 11, wherein said rocking portion cooperates with a guide profile integral with said baseplate which provides for a two-phase displacement of said rocking portion, namely:

a translating phase during which said rocking portion is in contact with said slide, and a rocking phase, at the end of the translation phase, in which said rocking portion is separated from said slide and is locked in a retracted position.

13. A binding according to claim 12, wherein said guide profile has a horizontal ramp parallel with the ski and a substantially vertical ramp, between which a release lug is located.

14. A binding according to claim 13, wherein said rocking portion is associated with a cradle hinged to said baseplate and adapted to move in a vertical plane.

15. A binding according to claim 14, wherein said rocking portion is integral with a threaded rod mounted slidingly in the cradle and equipped with an adjusting nut, the release spring surrounding said threaded rod between the nut and the cradle.

16. A binding according to claim 11, wherein when they cooperate, said slide and said rocking portion are in contact with each other along a line parallel with the plane of the ski.

17. A binding according to claim 16, wherein said slide and said rocking portion are each equipped, in a cooperating part, with an inclined sliding plane, the sliding plane of the slide being designed to cooperate with a ridge on said rocking portion, and the inclined plane of the rocking portion being designed to cooperate with a ridge upon said slide.

18. A binding according to claim 17, wherein said inclined planes of the slide and the rocking portion form between themselves an acute angle.

19. A binding according to claim 11, wherein said rocking portion cooperates with an element sensitive to the presence of the boot upon the ski, said element serving, when the ski is being refitted, to unlock said rocking portion and cause it to pass from its retracted position to the position in engagement with said slide.

20. A binding according to claim 19, wherein said element sensitive to the presence of the boot is a pedal hinged about a horizontal axis upon said baseplate.

21. A binding according to claim 20, wherein said pedal and said rocking portion cooperate through a system of ramps producing relative movement of these parts in relation to each other.

22. A binding according to claim 20, wherein said pedal and said rocking portion cooperate through a flap adapted to pivot about a horizontal axis of said pedal.

23. A binding according to claim 22, wherein said flap is urged into contact with said rocking portion by means of a spring one end of said spring being fastened to said flap and the other end to said pedal.

24. A binding according to claim 23, wherein the movement of the flap is limited in that it comes up against a projection upon said baseplate.

25. A binding according to claim 22, wherein a spring fastened to said pedal and said baseplate urges said pedal into a raised position away from the ski.

26. A binding according to claim 11, said binding further comprising a lever for the intentional removal of the ski, said lever acting upon said slide and displacing it against the action of the locking spring.

27. A binding according to claim 26, wherein said ski-removal lever is hinged to a bar which slides in a guide profile with which said slide cooperates.

28. A binding according to claim 27, wherein said ski-removal lever carries a ramp cooperating with a corresponding ramp upon said baseplate and producing displacement in translation of the end of said lever hinged to the bar.

29. A binding according to claim 11, wherein said binding is equipped with a lever for intentional removal of the ski, said lever being hinged to said slide, its actuation serving to displace said slide against the action of the locking spring.

30. A binding according to claim 29, wherein said ski-removal lever has a ramp cooperating with a corresponding ramp upon said baseplate and serving to displace in translation the end of the lever hinged to the slide.

* * * * *

Notice of Adverse Decision in Interference

In Interference No. 102,013, involving Patent No. 4,145,071, G. P. J. Salomon, SAFETY BINDING FOR SKI-BOOT WITH AUTOMATIC REFITTING, final judgment adverse to the patentee was rendered Jan. 25, 1989, as to claims 1-5.

[*Official Gazette May 30, 1989* ]